US006374449B1

(12) United States Patent
Jolly

(10) Patent No.: US 6,374,449 B1
(45) **Date of Patent: *Apr. 23, 2002**

(54) ATHLETIC SHOE CLEANER

(76) Inventor: William A. Jolly, 386 Deerwood Rd., Stoneville, NC (US) 27048

( * ) Notice: Subject to any disclaimer, the term of this patent is extended or adjusted under 35 U.S.C. 154(b) by 0 days.

This patent is subject to a terminal disclaimer.

(21) Appl. No.: 09/532,213

(22) Filed: Mar. 22, 2000

Related U.S. Application Data

(63) Continuation-in-part of application No. 09/024,083, filed on Feb. 17, 1998, now Pat. No. 6,076,222.

(51) Int. Cl.[7] ..... A46B 3/20
(52) U.S. Cl. ..... 15/161; 15/188
(58) Field of Search ..... 15/188, 187, 186, 15/160, 161, 217, 238, DIG. 5, 112

(56) References Cited

U.S. PATENT DOCUMENTS

| | | | | |
|---|---|---|---|---|
| 469,031 A | | 2/1892 | Post | |
| 988,207 A | * | 3/1911 | Oliva | 15/161 |
| 1,026,774 A | | 5/1912 | Schimper | |
| 1,196,453 A | | 8/1916 | Hatfield | |
| 1,698,005 A | | 1/1929 | Stanwood | |
| 2,176,917 A | * | 10/1939 | Mayers | 15/161 |
| 2,604,377 A | | 7/1952 | Eames | |
| 2,887,713 A | * | 5/1959 | Clark | 15/161 |
| 3,028,617 A | | 4/1962 | Racina | |
| 3,065,478 A | * | 11/1962 | Lawrin | 15/112 |
| 3,284,091 A | | 11/1966 | Spier | |
| 3,747,150 A | | 7/1973 | Kozub | |
| 3,826,518 A | | 7/1974 | Hennig | |
| 4,068,339 A | | 1/1978 | Maruyama et al. | |
| 4,343,265 A | | 8/1982 | Belschner | |
| 4,571,767 A | * | 2/1986 | Dangler | 15/161 |
| 5,067,196 A | | 11/1991 | Chen | |

(List continued on next page.)

FOREIGN PATENT DOCUMENTS

| | | |
|---|---|---|
| CH | 196815 | 6/1938 |
| FR | 2577129 | 8/1988 |
| GB | 23704 | * of 1912 |
| GB | 6584 | * of 1914 |
| GB | 283308 | 1/1928 |
| GB | 726943 | 3/1955 |
| GB | 2232580 | 12/1990 |
| IT | 444494 | 1/1949 |

OTHER PUBLICATIONS

Spikeless shoes are this season's golf trend by Pete Dougherty, electric Times Union Apr. 29, 1997.
Golfweb, Kleet Kleen 2000, Information from the Internet, 1994–1998, Month N/A.
Encyclopedia of Chemical Technology, 4th Edition, vol. 21, Recycling, Oil To Silicon 1997, Month N/A.
Softwalk Compression Golf Spikes, Information from the Internet; orginal date unknown.

*Primary Examiner*—Robert J. Warden, Sr.
*Assistant Examiner*—Kaj K. Olsen
(74) *Attorney, Agent, or Firm*—MacCord Mason PLLC

(57) ABSTRACT

An athletic shoe cleaner, adapted to be anchored in an earthen surface, for cleaning a shoe bottom, especially the bottom of a shoe having non-metal spikes. The athletic shoe cleaner includes a cleaning surface having a plurality of spaced apart rods, wherein each of the plurality of spaced apart rods is formed from a semi-rigid material. In the preferred embodiment, the cleaner includes a base for supporting the rods and an anchor plate that permits the cleaner to be mounted to an earthen surface such as turf. The anchor plate preferably includes a plurality of downwardly projecting, curved prongs that penetrate the earthen surface. Also, in the preferred embodiment, the base is generally round and the plurality of spaced apart rods are arranged in concentric rows with respect to the center of the cleaner, with the rods being radially offset from rods in adjacent concentric rows. The height of each of the plurality of spaced apart rods increases from the outer edge of the cleaning surface to the center.

58 Claims, 5 Drawing Sheets

U.S. PATENT DOCUMENTS 5,077,858 A * 1/1992 Lewis, Jr. ..... 15/161
5,259,129 A 11/1993 Deacon et al.
5,310,201 A 5/1994 Routh
5,367,793 A 11/1994 Deacon et al.
D371,453 S 7/1996 Deacon et al.
D372,355 S 8/1996 Deacon et al.
D373,675 S 9/1996 McMullin
D378,013 S 2/1997 McMullin
D380,076 S 6/1997 McMullin
5,664,278 A 9/1997 Reisman
D385,988 S 11/1997 McMullin
D387,548 S 12/1997 McMullin
6,076,222 A * 6/2000 Jolly ..... 15/161

* cited by examiner

ATHLETIC SHOE CLEANER

CROSS-REFERENCE TO RELATED APPLICATIONS

The present application is a continuation-in-part of U.S. patent application No. 09/024,083, filed Feb. 17, 1998 (now U.S. Pat. No. 6,076,222 issued Jun. 20, 2000).

BACKGROUND OF THE INVENTION (1) Field of the Invention

The present invention relates generally to athletic shoe cleaners and, more particularly, to a device for cleaning non-metal spiked golf shoes.

(2) Description of the Prior Art

Devices for cleaning conventional metal spiked golf shoes are well known. For example, U.S. Pat. No. 3,028,617, issued to Racina, discloses a bristled brush that is attachable to a pull cart for a golf bag. Similarly, U.S. Pat. No. 3,747,150, issued to Kozub, discloses double-sided bristle brush that can be attached to the wheel of a golf club pull cart. Stationary bristle brushes that are mounted at ground level, with the bristles pointed upwardly are also well known. The state of the art of athletic shoe cleaning devices, and golf shoe cleaning devices particularly, is based on the predominant use of metal spiked golf shoes.

There is a trend, however, in the golf industry toward non-metal spiked golf shoes. There are several advantages associated with the traditional metal spiked golf shoe. They provide excellent stability during the golf swing. Traction during walking with metal spiked golf shoes is also excellent. The disadvantage of the metal spikes, however, is that they extensively damage golf greens, fairways and golf club facilities. The damage caused by metal spiked golf shoes increases golf course maintenance costs and effects the quality of the golf course play. Because of these problems associated with the use of metal spiked golf shoes, many golf facilities have banned metal spiked golf shoes. Thus, there was a need in the golf shoe art for a golf shoe that would provide stability and traction yet reduce the damage to golf greens, fairways and club facilities.

Golf shoe cleats for use in place of a standard metal spike, such as those disclosed in U.S. Pat. No. 5,367,793, issued to Deacon et al., are known to cause significantly less damage to golf greens, fairways and facilities than conventional metal spikes.

There are, however, still disadvantages associates with non-metal spiked golf shoes. One of the most significant disadvantages is the loss of the excellent stability and traction associated with metal spiked golf shoes. This loss of stability and traction is exacerbated by the tendency of grass, dirt and other debris to collect on the bottom sole of non-metal spiked golf shoes. This collection of grass, dirt and debris further reduces stability and traction, especially under wet conditions and hilly terrain.

Conventional golf shoe cleaners, such as those discussed above, have serious disadvantages with respect to cleaning non-metal spiked golf shoes. Conventional golf shoe cleaners generally consist of a plurality of brush bristles anchored in a base. One disadvantage of such a cleaner is that brush bristles are not sufficiently rigid to dislodge grass, dirt, leaves and other debris from the bottom sole of a non-metal spiked golf shoe.

Another disadvantage associated with using conventional golf shoe cleaners with non-metal spiked golf shoes is that the flexibility of the brush bristles causes unwanted spray of mud, dirt and debris during the cleaning of the bottom sole of the golf shoe. This unwanted spray of mud, dirt and debris can cause soiling of the golfer's apparel, pants and socks and other nearby objects.

A further disadvantage of conventional golf shoe cleaners is the difficulty involved in cleaning the bottom of a golf shoe, particularly a non-metal spiked golf shoe during play. For example, the brush disclosed in U.S. Pat. No. 3,747,150, issued to Kozub, requires a golfer to stand on one foot and to maintain balance while cleaning the bottom of the shoe on the other foot. If the golfer loses balance, he may fall and suffer injury and/or damage to equipment and apparel. Another disadvantage associated with conventional golf shoe cleaners is the relatively high cost of manufacturing golf shoe cleaners comprised of brush bristles.

The golf shoe cleaner described in U.S. patent application No. 09/1024,083, filed on Feb. 17, 1998 by Jolly, of which the present application is a continuation-in-part, is adapted to be mounted onto a solid surface, such as a golf cart bumper or floorboard Ag. Mar. 21, 2000. This allows a golfer to periodically clean his or her shoes while out on the course. In some instances, however, a stationary shoe cleaner may be desired. Such a situation may arise at entryways to indoor facilities such as clubhouses or locker rooms. The amount of grass, dirt and debris tracked into such facilities by golfers can be greatly reduced by locating a shoe cleaner secured in the ground at or near entryways and sidewalks. Stationary shoe cleaners may also be located along the course on paths or at tee boxes as a convenience for those golfers who walk and Ag. Mar. 21, 2000 who do not have a portable shoe cleaner.

Accordingly, there remains a need for a new and improved golf shoe cleaner that can be secured in an earthen surface and is sufficiently rigid to be able to remove grass, dirt and debris from the bottom of non-metal spiked golf shoes while, at the same time, reduces the unwanted spray of dirt and debris associated with conventional bristle type golf shoe cleaners and is inexpensive and easy to manufacture.

SUMMARY OF THE INVENTION

The present invention is directed to an athletic shoe cleaner for cleaning a shoe bottom, especially the bottom of a shoe having non-metal spikes. The athletic shoe cleaner includes a cleaning surface having a plurality of spaced apart rods, wherein each of the plurality of spaced apart rods is formed from a semi-rigid material. In the preferred embodiment, the cleaner includes a flexible base for supporting the rods and permitting the cleaner to be mounted to a surface such as a fender of a golf cart. Also, in the preferred embodiment, the base is generally round and the plurality of spaced apart rods are arranged in an overlapping and radially symmetrical fashion with respect to the center of the cleaner with the height of each of the plurality of spaced apart rods increasing from the outer edge to the center.

The present invention further includes an anchoring means for attaching the base to an earthen surface. In the preferred embodiment, the anchoring means is a rigid anchor plate. The anchor plate includes a lower surface, the lower surface having a plurality of prongs, each of the plurality of prongs extending downward from the lower surface and being capable of penetrating the earthen surface.

The plurality of prongs preferably includes at least two pairs of opposing prongs, wherein each of the plurality of prongs is disposed proximate to an outer perimeter of the lower surface and wherein each of the plurality of prongs has a base attached to the lower surface and a tip distal to the base, and wherein each of the plurality of prongs is curved from the base to the tip.

The anchor plate further includes fasteners for affixing the anchor plate to the lower surface and wherein the base has a first plurality of apertures and the anchor plate has a second plurality of apertures, the each of first plurality of apertures and the second plurality of apertures being co-aligned and capable of accepting a fastener therethrough.

Accordingly, one aspect of the present invention is to provide an athletic shoe cleaner for cleaning a shoe bottom, the athletic shoe cleaner including: a cleaning surface including a plurality of spaced apart rods arranged in a plurality of concentric rows centered about a central point of the cleaner, wherein the plurality of rods in each of the plurality of concentric rows is radially offset from the plurality of rods in an adjacent concentric row; and an anchoring means for attaching the cleaning surface to an earthen surface.

Another aspect of the present invention is to provide in an athletic shoe cleaner for cleaning a shoe bottom, the athletic shoe cleaner including a cleaning surface including a plurality of spaced apart rods arranged in a plurality of concentric rows centered about a central point of the cleaner, wherein the plurality of rods in each of the plurality of concentric rows is radially offset from the plurality of rods in an adjacent concentric row and wherein each of the plurality of spaced apart rods is comprised of a semi-rigid material, the improvement including: an anchoring means for attaching the cleaning surface to an earthen surface.

Still another aspect of the present invention is to provide an athletic shoe cleaner for cleaning a shoe bottom, the athletic shoe cleaner including: a cleaning surface including a plurality of spaced apart rods arranged in a plurality of concentric rows centered about a central point of the cleaner, wherein the plurality of rods in each of the plurality of concentric rows is radially offset from the plurality of rods in an adjacent concentric row and wherein each of the plurality of spaced apart rods is comprised of a semi-rigid material; a base for supporting the rods; and an anchoring means for attaching the base to an earthen surface.

These and other aspects of the present invention will become apparent to those skilled in the art after a reading of the following description of the preferred embodiment when considered with the drawings.

BRIEF DESCRIPTION OF THE DRAWINGS

FIG. 2 is a bottom perspective of the athletic shoe cleaner of the parent application, shown in FIG. 1, illustrating an adhesive cavity for mounting the cleaner to a golf cart or the like;

DESCRIPTION OF THE PREFERRED EMBODIMENTS

Figure 1:
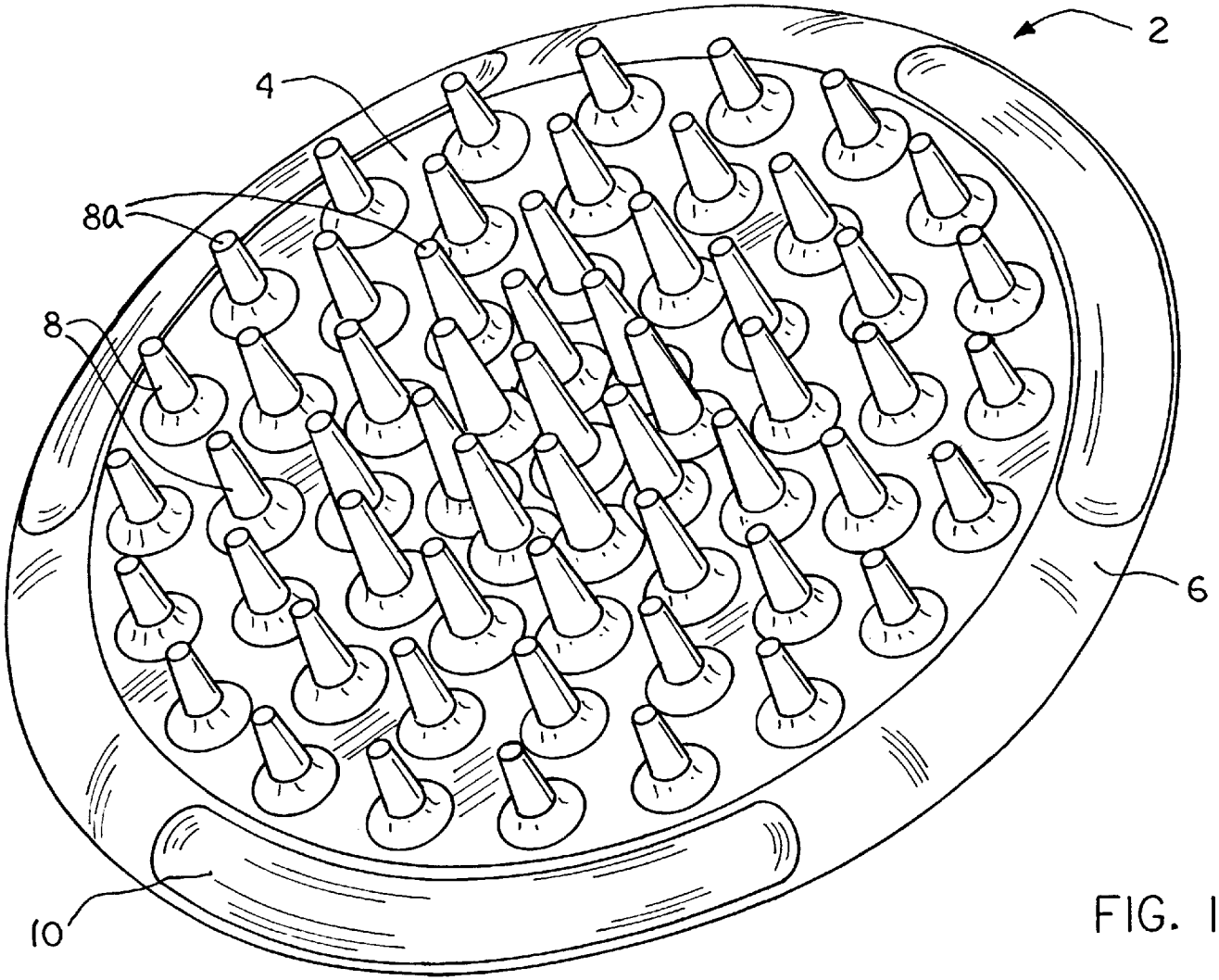
FIG. 1 is a front right perspective of an athletic shoe cleaner constructed according to the present invention;.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, an athletic shoe cleaner for cleaning the bottom surface of an athletic shoe, generally designated 2, is shown constructed according to the present invention. By "bottom," it is meant the bottom of the shoe sole, which comes into contact with the ground. In the preferred embodiment of the parent application, the athletic shoe cleaner 2 comprises a cleaning surface, generally designated 4, and a flexible base 6 adapted to allow the cleaner to be mounted onto the fender of a golf cart.

As shown in FIG. 1, the cleaning surface 4 is comprised of a plurality of the spaced apart rods 8 for cleaning dirt, mud, debris, grass and other foreign objects that may become lodged on the bottom of the shoe. The spacing between the rods permits easy removal of mud, dirt, debris and grass that has been dislodged from the shoe bottom, but remains lodged between the rods 8. It can be seen that the top side of the cavity defining lip Ag. Mar. 21, 2000 may include a plurality of indicia receiving regions 10 for displaying trademarks, logos and the like.

Figure 2:
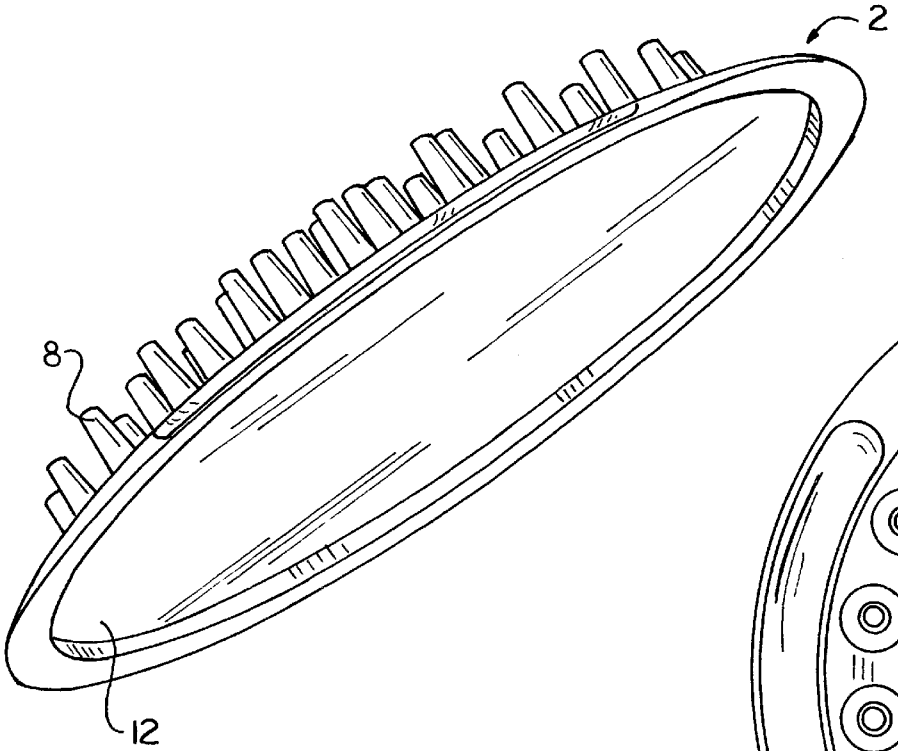

As best shown in FIG. 2, the bottom of the flexible base 6 of the cleaner described in the parent application includes a cavity defining lip 12 for receiving an adhesive for fixably attaching the athletic shoe cleaner 2 to an object, such as a golf cart fender.

Figure 3:
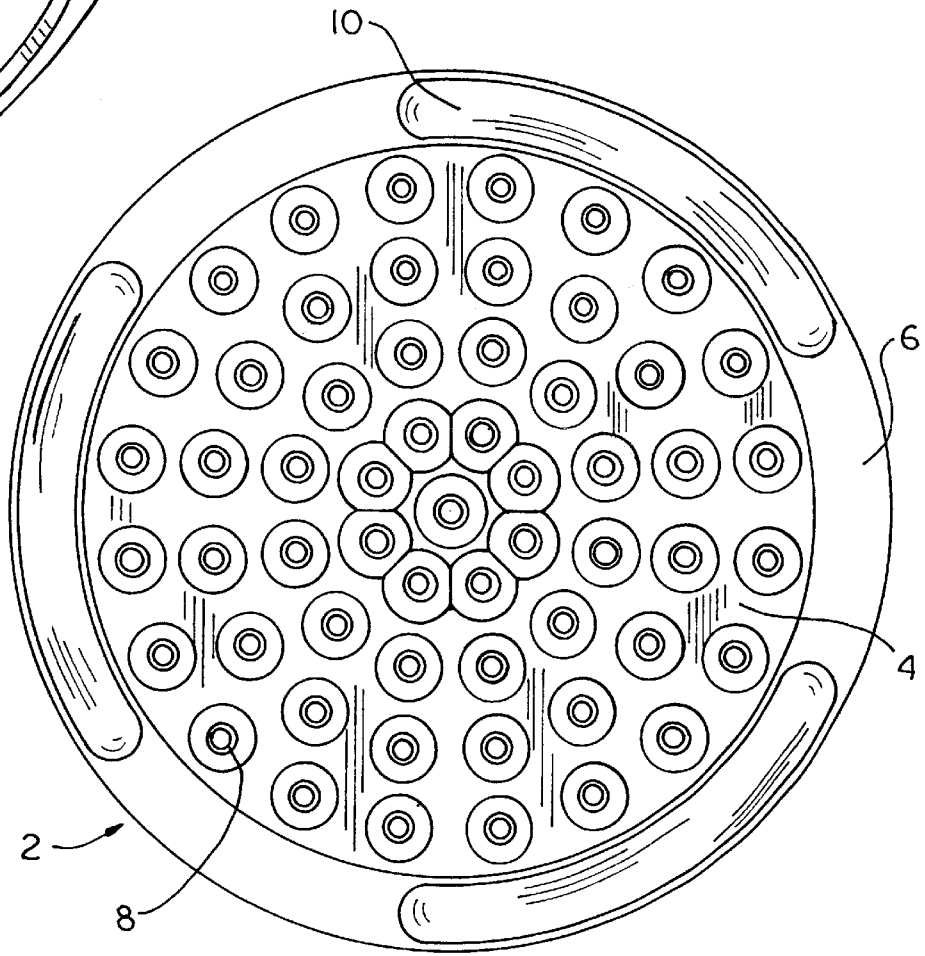
FIG. 3 is a top plan view of the athletic shoe cleaner illustrating the overlapping arrangement of the cleaning rods.

As best seen in FIG. 3, the plurality of spaced rods 8 are arranged in an overlapping, radially symmetrical fashion. Such an arrangement of the rods provides for better "cleaning action" than conventional bristle type cleaners where the bristles are arranged in straight rows and columns.

Figure 4:
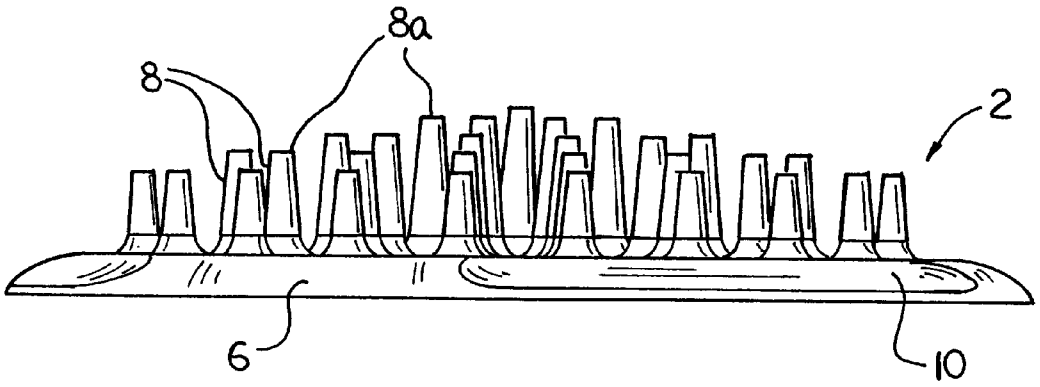
FIG. 4 is a side elevation view of the athletic shoe cleaner of the parent application.

As best seen in FIG. 4, each rod 8 is oriented on an axis perpendicular to the plane of the flexible base 6. As also shown in FIG. 4, the relative height of each rod 8 increases in height from the outside edge of the flexible base 6 to the center of flexible base 6. The differences in the heights of the rods 8 allows the athletic shoe cleaner to effectively dislodge foreign objects from a shoe bottom regardless of where on the cleaning surface 4 the shoe bottom is placed.

Figure 5:
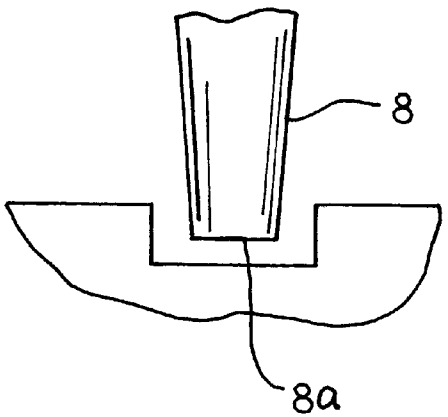
FIG. 5 is a cut away side view of an individual athletic shoe cleaner rod and a recess on an athletic shoe bottom.

As seen in FIG. 5, the top end 8*a* of each rod 8 is preferably truncated. The truncated top end 8*a*, as opposed to a pointed brush bristle, maximizes the contact of the cleaning surface of each rod. By "truncated," it is meant that the top end of each rod is flat or planar, as opposed to pointed.

Returning to FIG. 1, it can be seen that in the preferred embodiment, each rod 8 is tapered from the bottom end to the top end 8*a*. By "tapered" it is meant that the bottom end of the rod is wider than the top end of the rod. As seen in FIG. 5, tapering allows the rod end 8*a* to fit between the ridges of the shoe bottom while also providing a more rigid rod because of the greater thickness at the bottom end of the rod.

In the preferred embodiment, the plurality of spaced apart rods 8 are made of a semi-rigid material such as elastomeric rubber having a Shore Hardness value of greater than or equal to 80, with 100 being preferred. Such material is rigid enough to dislodge foreign objects from a shoe bottom, but not so rigid that the dislodged foreign objects are "sprayed" by the rapid "snapping" back of the rods to their original, upright position.

Each rod 8 is between about one-eighth (⅛) of an inch to one and one quarter inch in length as measured from the bottom end of the rod 8 to the top end 8*a* of the rod 8. In the most preferred embodiment, each rod 8 is between one-half inch and three-quarters of an inch in length, as measured from the bottom end of the rod 8 to the top end 8*a* of the rod 8. It has been found that rods less than about this height do not completely clean the bottom of the shoe. Rods greater than about this height clean but may cause unwanted spraying of debris.

The flexible base 6 is between about four inches to twelve inches wide, with six inches being preferred. The flexible base is comprised of elastomeric rubber with a Shore Hardness value of less than or equal to about 100. In the preferred embodiment, the flexible base 6 has at least five sides, with a round shape being preferred. Such a shape allows the athletic shoe cleaner of the parent application to be easily mounted on an object, such as a golf cart fender, without the need to have the athletic shoe cleaner be leveled in order to be aesthetically acceptable.

Figure 6:
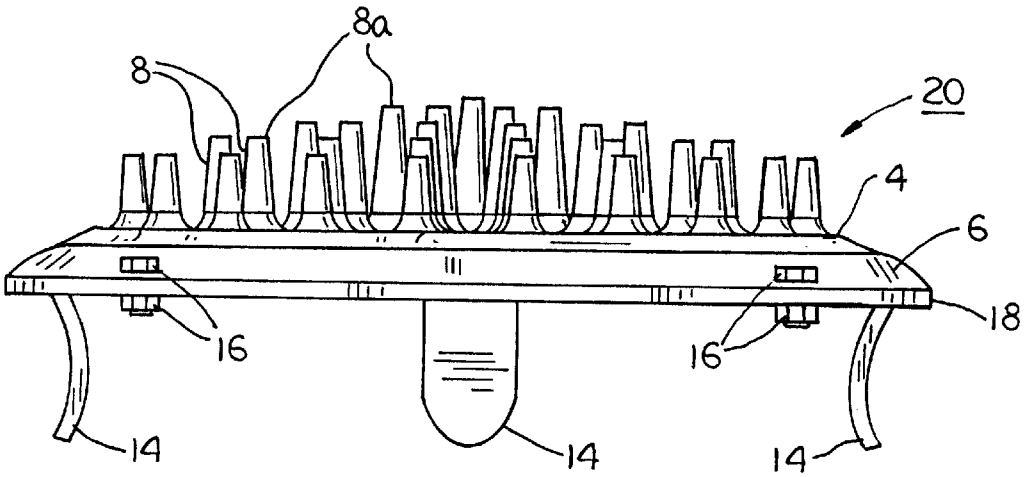
FIG. 6 is a side elevation view of an athletic shoe cleaner and anchor plate constructed according to the present invention.
Figure 7:
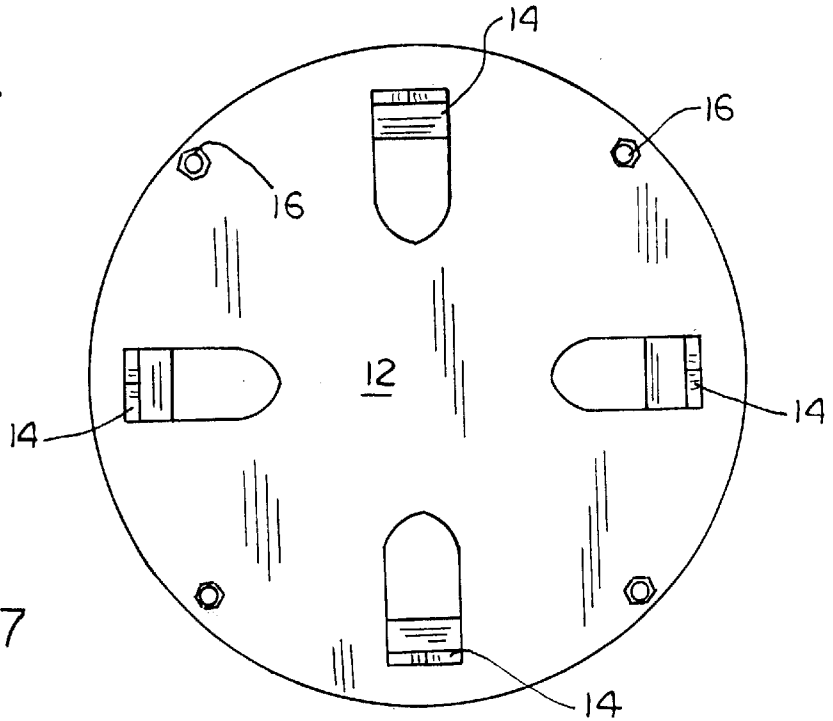
FIG. 7 is a bottom view of the anchor plate shown in FIG. 6.
Figure 8:
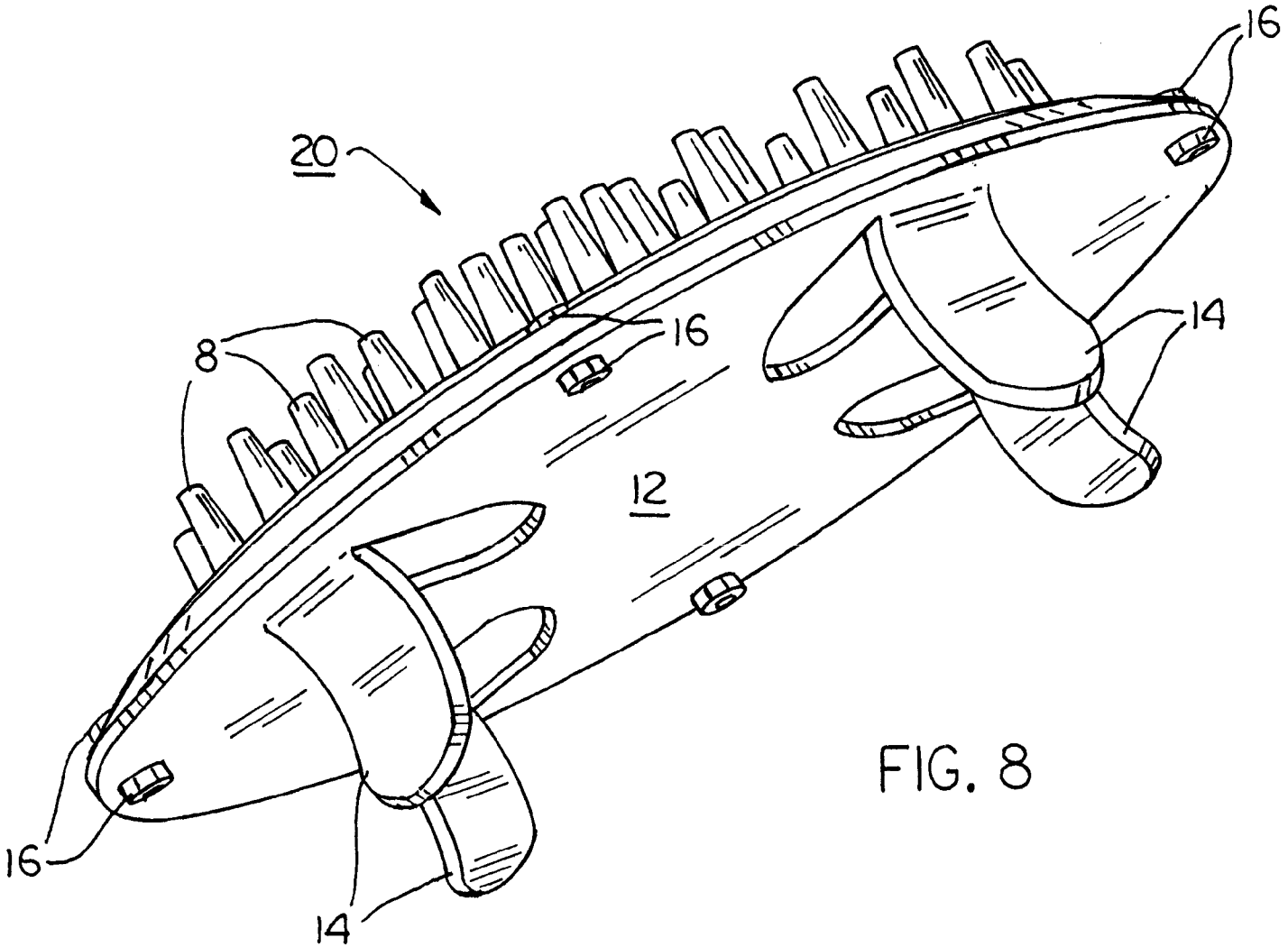
FIG. 8 is a bottom perspective of the athletic shoe cleaner and anchor plate shown in FIG. 6.

Side and bottom perspective views of the preferred embodiment of the athletic shoe cleaner 20 of the present invention are shown in FIGS. 6 and 8, respectively. Unlike the athletic shoe cleaner of the parent application, the base 6 of cleaning surface 4 of the athletic shoe cleaner 20 is attached to the top surface of a rigid anchor plate 18. Apertures on the flexible base 6 are co-aligned with apertures on the rigid anchor plate 18 to accommodate fasteners 16 that affix the base 6 and cleaning surface 4 to the rigid anchor plate 18. Alternatively, the flexible base 6 may be adhesively affixed to the rigid anchor plate 18. The rigid anchor plate 12 has a plurality of prongs 14 that extend downward from the bottom surface of the anchor plate 12. The prongs 14 are capable of penetrating an earthen surface and securing the athletic shoe cleaner 20 in the ground.

In the preferred embodiment of the present invention, two pairs of opposing prongs 14 are located near the outer perimeter of the rigid anchor plate 18 bottom surface. While the prongs 14 may have a straight profile, they are preferably curved to better secure the athletic shoe cleaner 20 in the type of surface that is commonly found on golf courses.

Surprisingly, it has been discovered that after being initially displaced by the prongs 14 during insertion, turf tends to "rebound" after about one hour, resealing the subsurface channels formed in the subsurface of the turf by the prongs 14 during insertion. Consequently, the curved profile of the prongs 14 provides an increase in resistance to accidental removal of the athletic shoe cleaner 20. This is shown by the results given in Table 1, which lists the relative force required to withdraw athletic shoe cleaners 20, with prongs 14 having both straight and curved profiles, from turf initially and after one hour after insertion.

The relative force required to remove the athletic shoe cleaner having four prongs is on a 1–5 scale with 3 being average and 5 being very good.

TABLE 1

| Prong Profile | Relative Removal Force (1–5) |
|---|---|
| Straight Vertical (initially) | 3 |
| Curved (initially) | 3 |
| Straight Vertical (after about 1 hr.) | 3 |
| Curved (after about 1 hr.) | 5 |

As can be seen, the curved pronged anchors actually become more securely attached with time, which, it is believed may be due to the turf rebounding after being displaced by the insertion of the curved prongs into the turf.

In the preferred embodiment, as best seen in FIG. 6, the center portion of each prong is curved inwardly while the distal portion of each prong returns substantially back to an imaginary line perpendicular to the bottom surface of the anchor plate. It is believed that this arrangement helps to prevent the prongs from bending unpredictably after repeated use. While inwardly curved prongs are preferred because of manufacturing and aesthetic considerations, it is expected that outwardly curved prongs should perform similarly.

In operation, the athletic shoe cleaner 2 of the parent application is fixably attached to an object, such as the rear fender of a golf cart, so that the plurality of spaced apart rods 8 extend outwardly on axes perpendicular to the plane of the golf cart fender. In the present invention, the athletic shoe cleaner 20 is placed on an earthen surface with the prongs 14 facing downward. Sufficient pressure is then applied to the cleaning surface 4 to force the prongs into the earthen surface. If the surface is turf, the pressure required to securely place the athletic shoe cleaner 20 in the surface may be applied by a grounds keeper's foot. To clean the shoe bottom, the golfer places the heel of the shoe upon the plurality of spaced apart rods of the mounted golf shoe cleaner 2. While pressing the shoe bottom against the plurality of spaced rods, the golfer scrapes or drags the shoe bottom across the top ends 8*a* of the plurality of the spaced apart rods 8. As the shoe bottom is scraped across the top ends 8*a* of plurality of the spaced apart rods 8, the rods 8 dislodge mud, dirt, debris, grass and any other foreign objects or materials that have adhered to the bottom of the golf shoe sole. The rods 8 are sufficiently rigid so that the dislodged objects or material are not sprayed on the golfer, the golfer's apparel, or other nearby objects and thereby soiling them. The golfer may repeat the scraping of the shoe bottom across the plurality of spaced apart rods 8 until the foreign objects and material that have adhered to the shoe bottom have been completely or nearly completely dislodged.

In the preferred embodiment of the parent application, an athletic shoe cleaner is mounted on both the right and left fenders of a golf cart so that two golfers can simultaneously clean a shoe bottom. In an alternate embodiment of the parent application, the athletic shoe cleaner may be mounted on ground level stationary objects, nearby entrances to buildings and the like so that a golfer may clean the shoe bottom prior to entering the building.

In the preferred embodiment of the present invention, the athletic shoe cleaner is mounted in earthen surfaces along paths, near tee boxes, adjacent to walkways having hard surfaces such as asphalt or concrete, and adjacent to entryways to structures such as clubhouses or locker rooms.

Certain modifications and improvements will occur to those skilled in the art upon a reading of the foregoing description. By way of example, while elastomeric rubber is the preferred material, other resilient polymers such as urethane and polyethylene could also be used. It should be understood that all such modifications and improvements have been deleted herein for the sake of conciseness and readability but are properly within the scope of the following claims.

I claim:

1. An athletic shoe cleaner for cleaning a shoe bottom, said athletic shoe cleaner comprising:

(a) a cleaning surface including a plurality of spaced apart rods arranged in a plurality of concentric rows centered about a central point of the cleaner, wherein the plurality of rods in each of said plurality of concentric rows is radially offset from the plurality of rods in an adjacent concentric row; and (b) an anchoring means for attaching said cleaning surface to an earthen surface.

2. The athletic shoe cleaner according to claim 1, further including a base for supporting said rods.

3. The athletic shoe cleaner according to claim 2, wherein the base is comprised of elastomeric rubber.

4. The athletic shoe cleaner according to claim 3, wherein the Shore Hardness value of the elastomeric rubber is less than or equal to about 100.

5. The athletic shoe cleaner according to claim 2, wherein the width of the base is between about 4 inches and 12 inches.

6. The athletic shoe cleaner according to claim 5, wherein the width of the base is about 6 inches.

7. The athletic shoe cleaner according to claim 2, wherein the base has five or more sides.

8. The athletic shoe cleaner according to claim 2, wherein the base is round.

9. The athletic shoe cleaner according to claim 2, further including an adhesive for mounting the athletic shoe cleaner onto a surface of said anchoring means.

10. The athletic shoe cleaner according to claim 2, further including a cavity defining lip for receiving an adhesive for mounting the athletic shoe cleaner onto a surface of said anchoring means.

11. The athletic shoe cleaner according to claim 2, further including at least one indicia receiving region.

12. In an athletic shoe cleaner for cleaning a shoe bottom, said athletic shoe cleaner including a cleaning surface including a plurality of spaced apart rods and wherein each of the plurality of spaced apart rods in concentric rows centered about a central point of the cleaner and wherein each of the plurality of concentrically spaced apart rods is comprised of a semi-rigid material, the improvement comprising: an anchoring means for attaching said cleannig surface to an earthen surface.

13. The athletic shoe cleaner of claim 12, wherein said anchoring means is a rigid anchor plate.

14. The athletic shoe cleaner of claim 13, wherein said anchor plate includes a lower surface, said lower surface having a plurality of prongs, each of said plurality of prongs extending downward from said lower surface and being capable of penetrating said earthen surface.

15. The athletic shoe cleaner of claim 14, wherein said plurality of prongs are at least two pairs of opposing prongs.

16. The athletic shoe cleaner of claim 14, wherein each of said plurality of prongs is disposed proximate to an outer perimeter of said lower surface.

17. The athletic shoe cleaner of claim 14, wherein each of said plurality of prongs has a base attached to said lower surface and a tip distal to said base, and wherein each of said plurality of prongs is curved from said base to said tip.

18. The athletic shoe cleaner of claim 13, wherein said anchor plate further includes securing means for affixing said anchor plate to said lower surface.

19. The athletic shoe cleaner of claim 18, wherein said base has a first plurality of apertures and said anchor plate has a second plurality of apertures, said each of first plurality of apertures and said second plurality of apertures being co-aligned and capable of accepting a fastener therethrough.

20. The athletic shoe cleaner of claim 18, wherein said fastener is a screw type fastener.

21. The athletic shoe cleaner according to claim 12, wherein the semi-rigid material is elastomeric rubber.

22. The athletic shoe cleaner according to claim 21, wherein the Shore Hardness value of the elastomeric rubber is greater than or equal to about 80.

23. The athletic shoe cleaner according to claim 22, wherein the Shore Hardness value of the elastomeric rubber is about 100.

24. The athletic shoe cleaner according to claim 12, wherein the plurality of spaced apart rods are arranged in an overlapping fashion.

25. The athletic shoe cleaner according to claim 24, wherein the plurality of spaced apart rods are arranged in a radially symmetrical fashion with respect to the center of the cleaner.

26. The athletic shoe cleaner according to claim 12, wherein the cleaning surface has an outer edge and a center, and the height of each of the plurality of spaced apart rods increases from the outer edge to the center.

27. The athletic shoe cleaner according to claim 12, wherein each of the plurality of spaced apart rods is between about ⅛ and 1¼ inches in height.

28. The athletic shoe cleaner according to claim 27, wherein each of the plurality of spaced apart rods is between ½ and ¾ inches in height.

29. The athletic shoe cleaner according to claim 12, wherein each of the plurality of spaced apart rods has a top end and a bottom end, and wherein the top end is truncated.

30. The athletic shoe cleaner according to claim 12, wherein each of the plurality of spaced apart rods has a top end and a bottom end and wherein each of the plurality of spaced apart rods is tapered from the bottom end to the top end.

31. An athletic shoe cleaner for cleaning a shoe bottom, said athletic shoe cleaner comprising:

(a) a cleaning surface including a plurality of spaced apart rods arranged in a plurality of concentric rows centered about a central point of the cleaner, wherein the plurality of rods in each of said plurality of concentric rows is radially offset from the plurality of rods in an adjacent concentric row and wherein each of the plurality of spaced apart rods is comprised of a semi-rigid material;

(b) a base for supporting said rods; and (c) an anchoring means for attaching said base to an earthen surface.

32. The athletic shoe cleaner according to claim 31, wherein the base is comprised of elastomeric rubber.

33. The athletic shoe cleaner according to claim 32, wherein the Shore Hardness value of the elastomeric rubber is less than or equal to about 100.

34. The athletic shoe cleaner according to claim 31, wherein the width of the base is between about 4 inches and 12 inches.

35. The athletic shoe cleaner according to claim 34, wherein the width of the base is about 6 inches.

36. The athletic shoe cleaner according to claim 31, wherein the base has five or more sides.

37. The athletic shoe cleaner according to claim 31, wherein the base is round.

38. The athletic shoe cleaner according to claim 31, further including an adhesive for mounting the athletic shoe cleaner onto a surface of said anchoring means.

39. The athletic shoe cleaner according to claim 31, further including a cavity defining lip for receiving an adhesive for mounting the athletic shoe cleaner onto a surface of said anchoring means.

40. The athletic shoe cleaner according to claim 31, further including at least one indicia receiving region.

41. The athletic shoe cleaner of claim 31, wherein said anchoring means is a rigid anchor plate.

42. The athletic shoe cleaner of claim 41, wherein said anchor plate includes a lower surface, said lower surface having a plurality of prongs, each of said plurality of prongs extending downward from said lower surface and being capable of penetrating said earthen surface.

43. The athletic shoe cleaner of claim 42, wherein said plurality of prongs are at least two pairs of opposing prongs.

44. The athletic shoe cleaner of claim 42, wherein each of said plurality of prongs is disposed proximate to an outer perimeter of said lower surface.

45. The athletic shoe cleaner of claim 42, wherein each of said plurality of prongs has a base attached to said lower surface and a tip distal to said base, and wherein each of said plurality of prongs is curved from said base to said tip.

46. The athletic shoe cleaner of claim 41, wherein said anchor plate further includes securing means for affixing said anchor plate to said lower surface.

47. The athletic shoe cleaner of claim 46, wherein said base has a first plurality of apertures and said anchor plate has a second plurality of apertures, said each of first plurality of apertures and said second plurality of apertures being co-aligned and capable of accepting a fastener therethrough.

48. The athletic shoe cleaner of claim 46, wherein said fastener is a screw type fastener.

49. The athletic shoe cleaner according to claim 31, wherein the semi-rigid material is elastomeric rubber.

50. The athletic shoe cleaner according to claim 49, wherein the Shore Hardness value of the elastomeric rubber is greater than or equal to about 80.

51. The athletic shoe cleaner according to claim 50, wherein the Shore Hardness value of the elastomeric rubber is about 100.

52. The athletic shoe cleaner according to claim 31, wherein the plurality of spaced apart rods are arranged in an overlapping fashion.

53. The athletic shoe cleaner according to claim 52, wherein the plurality of spaced apart rods are arranged in a radially symmetrical fashion with respect to the center of the cleaner.

54. The athletic shoe cleaner according to claim 31, wherein the cleaning surface has an outer edge and a center, and the height of each of the plurality of spaced apart rods increases from the outer edge to the center.

55. The athletic shoe cleaner according to claim 31, wherein each of the plurality of spaced apart rods is between about ⅛ and 1¼ inches in height.

56. The athletic shoe cleaner according to claim 55, wherein each of the plurality of spaced apart rods is between ½ and ¾ inches in height.

57. The athletic shoe cleaner according to claim 31, wherein each of the plurality of spaced apart rods has a top end and a bottom end, and wherein the top end is truncated.

58. The athletic shoe cleaner according to claim 31, wherein each of the plurality of spaced apart rods has a top end and a bottom end and wherein each of the plurality of spaced apart rods is tapered from the bottom end to the top end.

* * * * *